US005961395A

United States Patent [19]

You

[11] Patent Number: 5,961,395

[45] Date of Patent: Oct. 5, 1999

[54] GOLF CLUB

[76] Inventor: Chin-San You, No. 6, Lane 477, Sec. 2, Feng-Shynn Rd., Taichung Hsien, Taiwan

[21] Appl. No.: 08/969,572

[22] Filed: Nov. 13, 1997

Related U.S. Application Data

[63] Continuation-in-part of application No. 08/814,012, Mar. 10, 1997, abandoned.

[51] Int. Cl.[6] ..... A63B 53/10

[52] U.S. Cl. ..... 473/319

[58] Field of Search ..... 473/316, 318, 473/319, 320, 321, 322

[56] References Cited

U.S. PATENT DOCUMENTS

| | | | |
|---|---|---|---|
| 3,998,458 | 12/1976 | Inoue et al. | 473/319 |
| 4,135,035 | 1/1979 | Branen et al. | 473/319 |
| 4,157,181 | 6/1979 | Cecka | 473/319 |
| 4,725,060 | 2/1988 | Iwanaga | 473/319 |
| 5,143,374 | 9/1992 | Shibasaki | 473/319 |
| 5,437,450 | 8/1995 | Akatsuka et al. | 473/319 |

*Primary Examiner*—Steven Wong
*Attorney, Agent, or Firm*—Browdy and Neimark

[57] ABSTRACT

A golf club is composed of an inner tube and an outer tube. The inner tube is tapered in shape and is composed of a plurality of first and second fiber braids. The outer tube is made of a plurality of third fiber braids and wound around the inner tube to reinforce the structural strength of the edge of the plastic composite which forms the inner tube. The overall structural strength of the golf club is further enhanced by a netted outer tube made of a plurality of fourth and fifth fiber braids. The netted outer tube also serves to smooth the outer surface of the golf club.

4 Claims, 3 Drawing Sheets

GOLF CLUB

CROSS REFERENCE TO RELATED APPLICATIONS

The present application is a continuation-in-part application Ser. No. 08/814,012, filed Mar. 10, 1997, now abandoned the entire contents of which are hereby incorporated by reference.

FIELD OF INVENTION

The present invention relates to a golf club, and, more particularly, to a reinforced, light weight golf club.

BACKGROUND OF INVENTION

Conventional golf clubs are generally made of metal or of a fiber-reinforced plastic composite material. Because metal golf clubs are relatively heavy and have poor elasticity, metal golf clubs are gradually being replaced by golf clubs made of fiber-reinforced plastic materials.

Conventional golf clubs made of fiber-reinforced plastic composite materials are made of a plurality of braided fiber materials which are arranged in a parallel manner before they are impregnated with an appropriate amount of thermoplastic or thermosetting resin to form a platelike fiber fabric plate on which a tapered long rod is disposed. The tapered long rod is then rolled in a predetermined direction such that the fiber fabric plate is wound around the tapered long rod. By being wound around a tapered rod, the fiber fabric plate assumes a tapered shape. The tapered fiber fabric plate is then heated to set the shape.

Because the fiber fabric plate has a length and a width, both sides along the axis of the tapered long rod are vulnerable to severance. The structural integrity of the severed fiber braids is, therefore, seriously compromised. The conventional method for overcoming such a deficiency is to use a fiber fabric plate which has a greater width than is conventional so as to increase the number of windings of the fiber fabric plate, thereby enhancing the structural strength of the golf club. However, widening the fiber fabric plate in this matter substantially increases the cost of making the golf club and substantially increases the weight of the golf club as well.

SUMMARY OF INVENTION

It is an object of the present invention to provide a strong, light-weight golf club which can be produced at a reasonable cost.

It is another object of the present invention to provide a golf club which is properly reinforced.

The golf club according to the present invention comprises an inner tube and an outer tube. The inner tube is made of a tapered body, which has at least two fiber-reinforced plastic composite material layers made by a sheet winding method using a prepreg containing a plurality of first fiber braids oriented at a predetermined angle with respect to the longitudinal axis of the inner tube. The outer tube is formed of a fiber-reinforced plastic composite material winding having a plurality of second fiber braids wound around the inner tube such that the axis of the golf club forms an angle with each of said second fiber braids which are wound around the small-diameter end and the large-diameter end of the tapered inner tube.

Additionally, the outer tube may also be reinforced by a flexible sleeve braided by a plurality of third and fourth fiber braids so as to strengthen the club uniformly and to smooth the surface of the club.

DETAILED DESCRIPTION OF THE INVENTION

Figure 1:
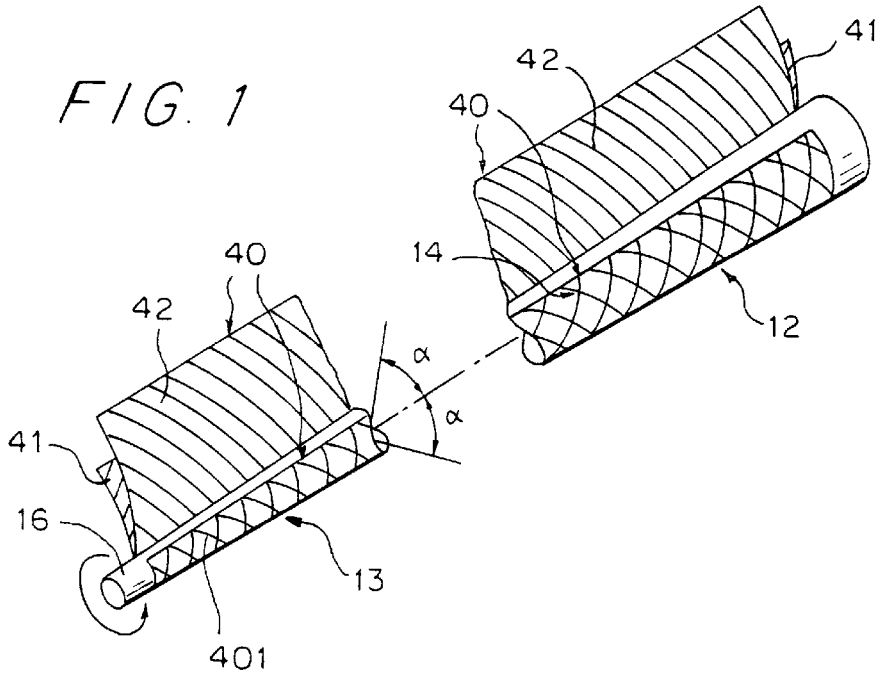
FIG. 1 shows a perspective view of the inner tube of a first preferred embodiment of the present invention.
Figure 2:
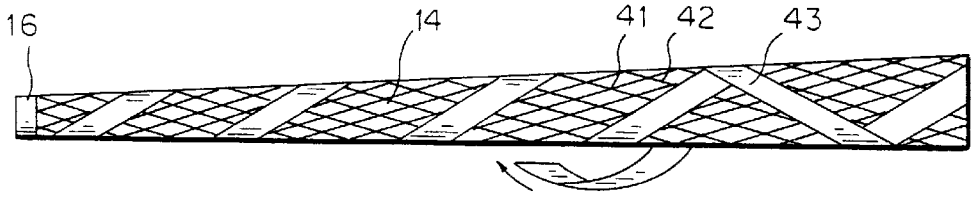
FIG. 2 shows a perspective view of the outer tube of a first preferred embodiment of the present invention.

As shown in FIGS. 1 and 2, a golf club 10 according to the present invention has a large-diameter end 12 and a small-diameter diameter end 13. The golf club 10, which has a tapered construction, comprises an inner tube 14 and an outer tube 15.

The inner tube 14 is made of two fiber-reinforced plastic composite material layers 41 and 42. The first layer, 41, is made by a sheet winding method using a prepreg containing a plurality of first fiber braids 401 oriented at a predetermined angle $\alpha$ with respect to the longitudinal axis of said inner tube 14. The second layer 42 is also arranged in a similar manner.

Figure 3:
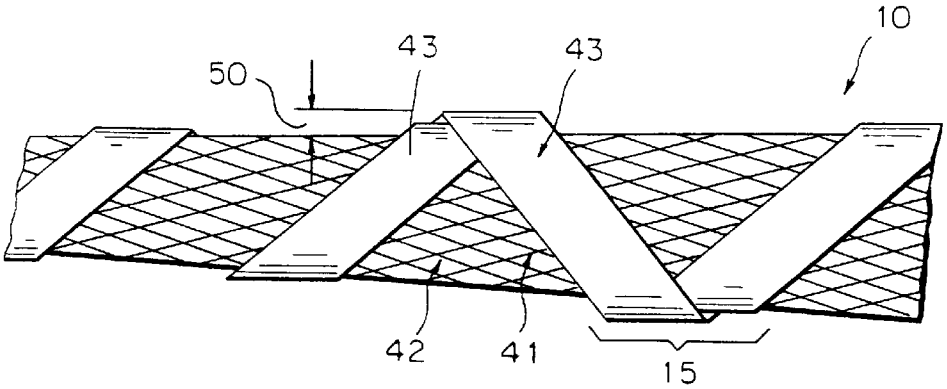
FIG. 3 shows a partial enlarged portion of the first preferred embodiment of the present invention.

As shown also in FIG. 3, the outer tube 15 is made of a fiber-reinforced plastic composite material winding having a plurality of second fiber braids 43 wound around said inner tube 14. The inner tube 14 is first wound around a tapered rod 16 before the outer tube 15 is wound around the inner tube 14 such that the outer tube 15 has the appropriate pitch, as illustrated in FIG. 2. The outer tube is wound repeatedly to eliminate the pitch gap. The outer tube 15 provides uniform structural strength to the club. In addition, the outer tube 15 is capable of preventing the severance of a vulnerable portion 40 located around the edge of the inner tube 14. This vulnerable portion 40 is susceptible to damage caused by stress.

The angles formed by the axis of the tapered rod 16 and the second fiber braids 43 corresponding in location to the large-diameter end 12 and the small-diameter end 13 may vary. In order to strengthen the small-diameter end 13, a considerably smaller angle may be formed between the axis of the tapered rod 16 and the second fiber braids 43 located at the small-diameter end 13.

As shown in FIG. 3, a head 50 is formed between the outer surface of the inner tube 14 and the pitch portion in view of the thick second fiber braids 43. As a result, the golf club 10 tends to have a number of recesses on its outer surface. The outer tube 15 cannot be made easily and economically.

Figure 4:
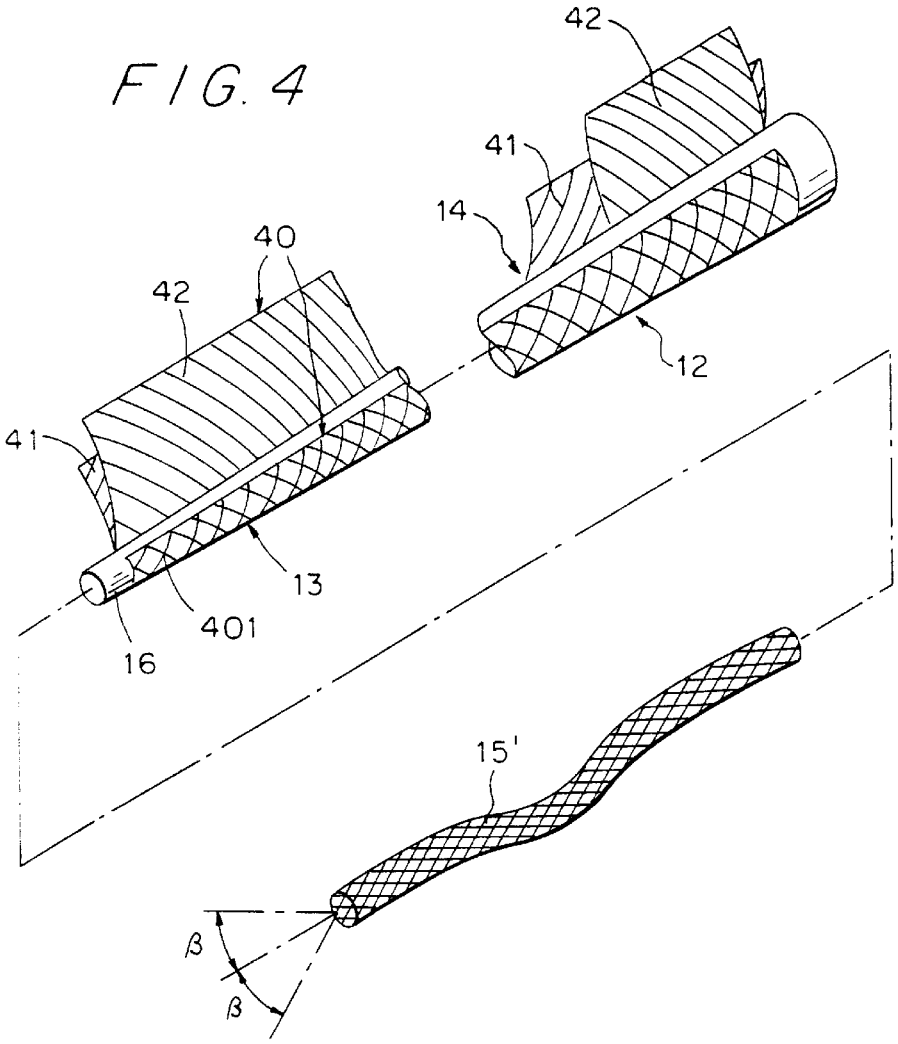
FIG. 4 shows a perspective view of a second preferred embodiment of the present invention.
Figure 5:
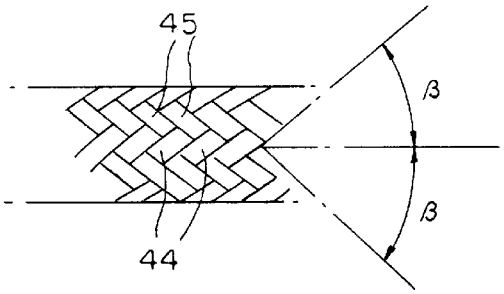
FIG. 5 shows a partial enlarged portion of the outer tube of the second preferred embodiment of the present invention.

In order to smooth the outer surface of the golf club 10, the outer tube 15 may be formed by a flexible sleeve 15', shown in FIG. 4. This flexible sleeve 15' is formed of a plurality of third fiber braids 44 and fourth fiber braids 45, and then impregnated with a thermosetting resin. As the fiber braids 44 and 45 are in a natural state, they form respectively with the longitudinal axis of the club 10 an appropriate initial angle β, as shown in FIGS. 4 and 5.

Figure 6:
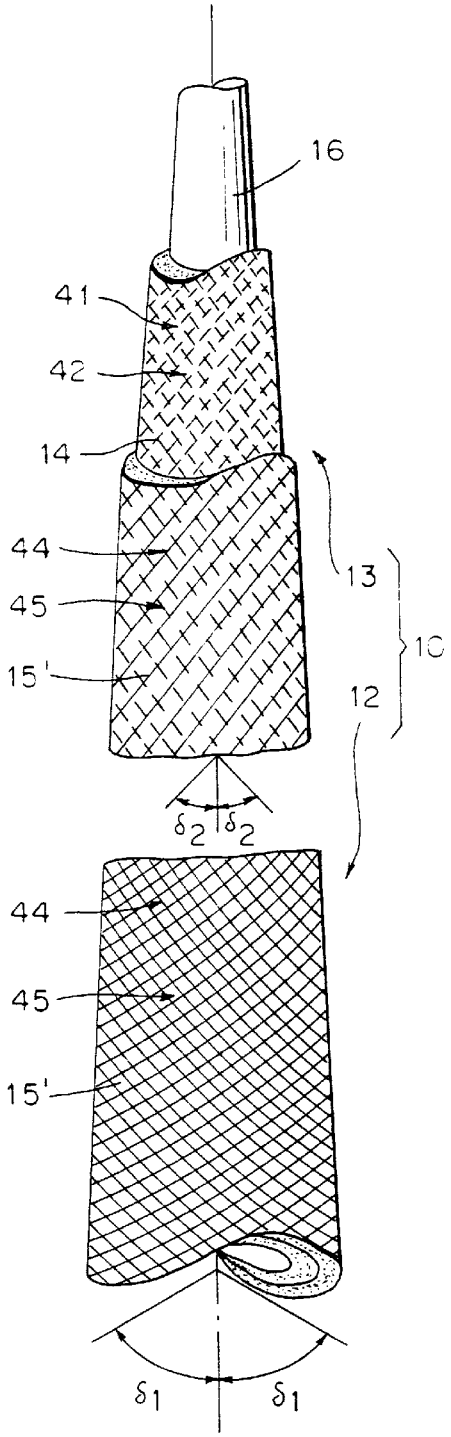
FIG. 6 shows another perspective view of the second preferred embodiment of the present invention.

As illustrated in FIG. 6, when the sleeve 15' is joined with the inner tube 14, the sleeve 15' corresponding to the large-diameter end 12 is expanded such that the initial angle β is changed to a first angle δ1 which is greater than the initial angle β.

The sleeve 15' is coated with oriented polypropylene and baked along with the inner tube 14. The oriented polypropylene shrinks during the heating process so as to cause sleeve 15' corresponding to the small-diameter end 13 to adhere to the outer surface of the small-diameter end 13. As a result, the above-mentioned initial angle 5 is changed to a second angle δ2 which is slightly smaller than the initial angle β.

The golf club 10 of the present invention with the sleeve 15' has the following features:

The inner tube 14 is reinforced by the third and the fourth fiber braids 44 and 45 of the sleeve 15' such that severance of the vulnerable portion 40 located around the edge of the inner tube 14 is minimized.

The longitudinal axis of the golf club 10 forms a relatively small angle δ1 along with the third and the fourth fiber braids 44 and 45, which correspond in location to the small-diameter end 13. As a result, the structural strength of the small-diameter end is effectively reinforced.

If the inner diameter of the sleeve 15' is equal to the outer diameter of the small-diameter end 13, the longitudinal axis of the golf club 10 forms a first angle δ1 along with the third and the fourth fiber braids 44 and 45 which correspond in location to the large-diameter end 12. The first angle δ1 is slightly greater than the initial angle β. In the meantime, the second angle δ2 formed in relation to the small-diameter end 13 is equal to the initial angle β, but smaller than the first angle δ1.

Figure 7:
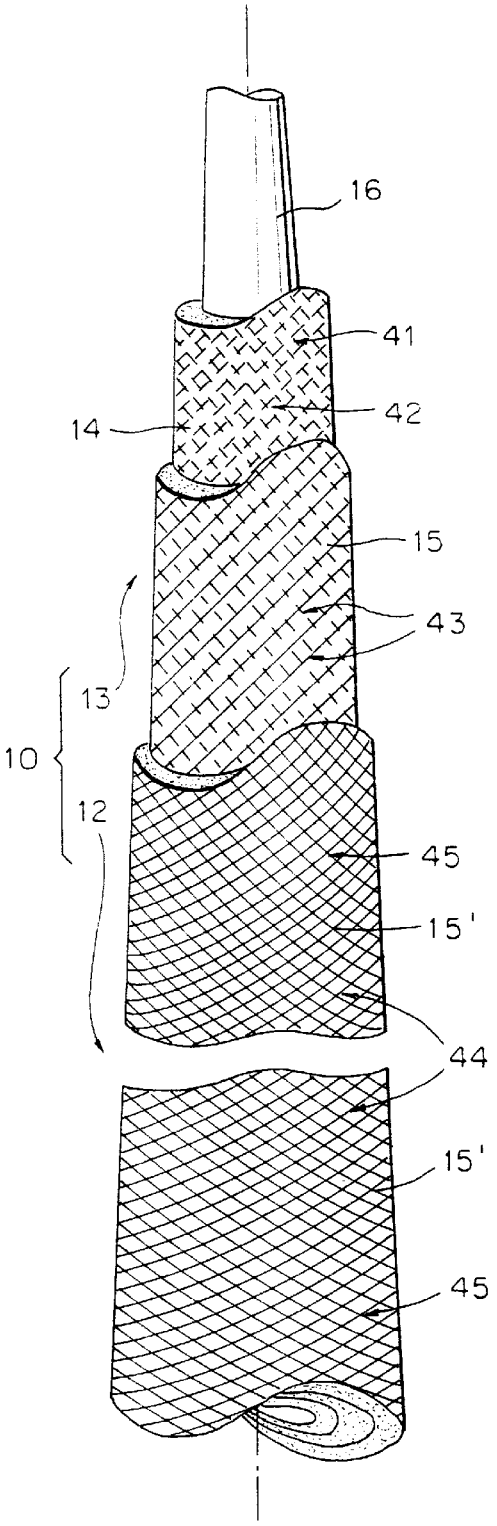
FIG. 7 shows a perspective view of a third preferred embodiment of the present invention.

As shown in FIG. 7, the golf club 10 of the present invention may be composed of the outer tube 15 and the sleeve 15' in addition to the inner tube 14. The sleeve 15' is fitted over the outer tube 15 so as to provide the golf club 10 with a greater structure strength as well as a smooth outer surface.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same function can be used; and it is intended that such expressions be given their broadest interpretation.

What is claimed is:

1. A golf club comprising:

a tapered inner tube having a large-diameter end and a small-diameter end, said tapered inner tube having at least two fiber-reinforced plastic composite material layers made by a sheet winding method using a prepreg containing a plurality of first fiber braids oriented at a predetermined angle with respect to the longitudinal axis of said tapered inner tube; and an outer tube formed of a fiber-reinforced plastic composite material winding having a plurality of second fiber braids wound around said inner tube such that the axis of a golf club forms a first angle with each of said second fiber braids which are wound around the small-diameter end and said axis of said golf club forms a second angle with each of the second fiber braids which are wound around the large-diameter end of said tapered inner tube.

2. A golf club according to claim 1, wherein said first angle formed in relation to the small-diameter end of said tapered inner tube is smaller than said second angle formed in relation to the large-diameter end of said tapered inner tube.

3. A golf club comprising:

a tapered inner tube having a large-diameter end and a small-diameter end, said tapered inner tube having at least two fiber-reinforced plastic composite material layers made by a sheet winding method using a prepreg containing a plurality of first fiber braids oriented at a predetermined angle with respect to the longitudinal axis of said inner tube; and a first outer tube having a flexible sleeve formed by a plurality of third and fourth fiber braids covering said inner tube such the axis of said golf club forms a first angle with each of said third and fourth fiber braids which cover the large-diameter end of said golf club, and that said axis of said golf club forms a second angle with each of said third and fourth fiber braids which cover the small-diameter end of said golf club, said first angle being greater than said second angle.

4. A golf club according to claim 3 further comprising a second outer tube located between said inner tube and said first outer tube, said second outer tube being formed of a fiber-reinforced plastic composite material winding having a plurality of fiber braids wound around inner tube.

* * * * *